US007886539B2

(12) United States Patent
Cai

(10) Patent No.: US 7,886,539 B2
(45) Date of Patent: Feb. 15, 2011

(54) MULTI-STAGE AXIAL COMBUSTION SYSTEM

(75) Inventor: Weidong Cai, Oviedo, FL (US)

(73) Assignee: Siemens Energy, Inc., Orlando, FL (US)

( * ) Notice: Subject to any disclaimer, the term of this patent is extended or adjusted under 35 U.S.C. 154(b) by 463 days.

(21) Appl. No.: 12/024,339

(22) Filed: Feb. 1, 2008

(65) Prior Publication Data

US 2009/0071157 A1 Mar. 19, 2009

Related U.S. Application Data

(60) Provisional application No. 60/972,400, filed on Sep. 14, 2007.

(51) Int. Cl.
*F02C 3/00* (2006.01)

(52) U.S. Cl. ..... 60/732; 60/733; 60/737

(58) Field of Classification Search ..... 60/732, 60/733, 737, 776, 752, 746; 431/158, 8–9, 431/178, 179, 278, 284, 285, 350, 351–353; *F23R 3/42*
See application file for complete search history.

(56) References Cited

U.S. PATENT DOCUMENTS

| | | | | | |
|---|---|---|---|---|---|
| 1,322,999 | A | * | 11/1919 | Bester | 431/84 |
| 3,490,230 | A | * | 1/1970 | Suter et al. | 60/39.23 |
| 3,792,582 | A | * | 2/1974 | Markowski | 60/737 |
| 3,872,664 | A | * | 3/1975 | Lohmann et al. | 60/746 |
| 4,285,193 | A | * | 8/1981 | Shaw et al. | 60/777 |
| 5,623,819 | A | | 4/1997 | Bowker et al. | |
| 5,640,851 | A | | 6/1997 | Toon et al. | |
| 5,802,854 | A | | 9/1998 | Maeda et al. | |
| 5,850,731 | A | | 12/1998 | Beebe et al. | |
| 6,192,688 | B1 | | 2/2001 | Beebe | |
| 6,201,029 | B1 | | 3/2001 | Waycuilis | |
| 6,332,313 | B1 | | 12/2001 | Willis et al. | |
| 6,418,725 | B1 | | 7/2002 | Maeda et al. | |
| 6,513,334 | B2 | | 2/2003 | Varney | |
| 7,198,453 | B2 | | 4/2007 | Hall | |

FOREIGN PATENT DOCUMENTS

| | | | |
|---|---|---|---|
| EP | 1055879 | A1 | 11/2000 |
| EP | 1493972 | A1 | 7/2003 |
| EP | 1777459 | A2 | 10/2006 |
| EP | 1985927 | A2 | 10/2008 |
| FR | 1079767 | | 12/1954 |
| WO | 9207221 | A1 | 4/1992 |
| WO | 2009142026 | A1 | 11/2009 |

* cited by examiner

*Primary Examiner*—Michael Cuff
*Assistant Examiner*—Vikansha S Dwivedi

(57) ABSTRACT

A gas turbine combustion system is provided comprising a combustion chamber (16) having a central axis (44), a primary combustion stage (28) located at a front end (32) of the combustion chamber (16) for injecting fuel, air, or mixtures thereof substantially along the central axis (44), a plurality of secondary combustion stages (30A-D) spaced apart in flow series along a length of the combustion chamber (16), wherein each of the plurality of secondary combustion stages (30A-D) comprises a plurality of circumferentially-spaced secondary injectors (48) for injecting fuel, air, or mixtures thereof, toward the central axis (44), and wherein an internal diameter of the combustion chamber (16) decreases from at least a first one of the plurality of secondary combustion stages (30AD) to at least a second one of the plurality of secondary combustion stages (30A-D).

10 Claims, 3 Drawing Sheets

MULTI-STAGE AXIAL COMBUSTION SYSTEM

This application claims benefit under 35 USC 119(e)(1) of the Sep. 14, 2007 filing date of U.S. provisional application 60/972,400, incorporated by reference herein.

FIELD OF THE INVENTION

The present invention relates to a gas turbine combustion system, and more particularly to a multi-stage axial combustion system that provides a highly efficient combustion process with significantly lower NOx emissions.

BACKGROUND OF THE INVENTION

The concentration of nitrogen oxide (NOx) emissions in the exhaust gas produced by the combustion of fuel in gas turbine combustion system has been a longstanding concern in the field. Currently, the emission level requirement is less than 25 ppm of NOx for an industrial gas exhaust. Nitrogen oxides (NOx) include various nitrogen compounds such as nitrogen dioxide (NO2) and nitric oxide (NO). These compounds play a key role in the formation of harmful particulate matter, smog (ground-level ozone), and acid rain. Further, these compounds contribute to eutrophication (the buildup of nutrients in coastal estuaries) that in turn leads to oxygen depletion, which degrades water quality and harms marine life. NOx emissions also contribute to haze air pollution in our national parks and wilderness areas. As a result, gas turbine combustion systems having low NOx emissions are of utmost importance.

The primary method for reducing NOx emissions in gas combustion systems is to reduce the combustion reaction temperature by reducing the flame temperature. For example, as discussed in U.S. Pat. No. 6,418,725, one conventional method for reducing NOx emissions to inject steam or water into the high-temperature combustion area to reduce the flame temperature during the combustion. The deficiencies of this method include the requirement for a large amount of water or steam and reduced combustor lifetime due to increased combustor vibrations resulting from the injection of water. Moreover, reducing the flame temperature results in a significant drop in efficiency of the combustion system as it is well-known that lowering the flame temperature substantially reduces combustion efficiency. Accordingly, combustion systems that are able to maintain a relatively high flame temperature for combustion efficiency and are able to maintain low NOx emissions are desired.

BRIEF DESCRIPTION OF THE DRAWINGS

The invention is explained in the following description in view of the drawings that show.

DETAILED DESCRIPTION OF THE INVENTION

The inventor of the present invention has developed a multi-stage axial system having a primary combustion stage at a front end of the combustion chamber, and a plurality of secondary combustion stages spaced apart in flow series along a length of the combustion chamber where an internal diameter of the combustion chamber decreases from at least a first one of the plurality of secondary combustion stages to at least a second one of the plurality of secondary combustion stages. Advantageously, the novel multi-stage axial combustion system of the present invention provides uniform combustion, a high level of mixing, reduced residence time, and a high flame temperature, and thereby results in a highly efficient combustion process with significantly lower NOx emissions than prior art combustion systems.

Figure 1:
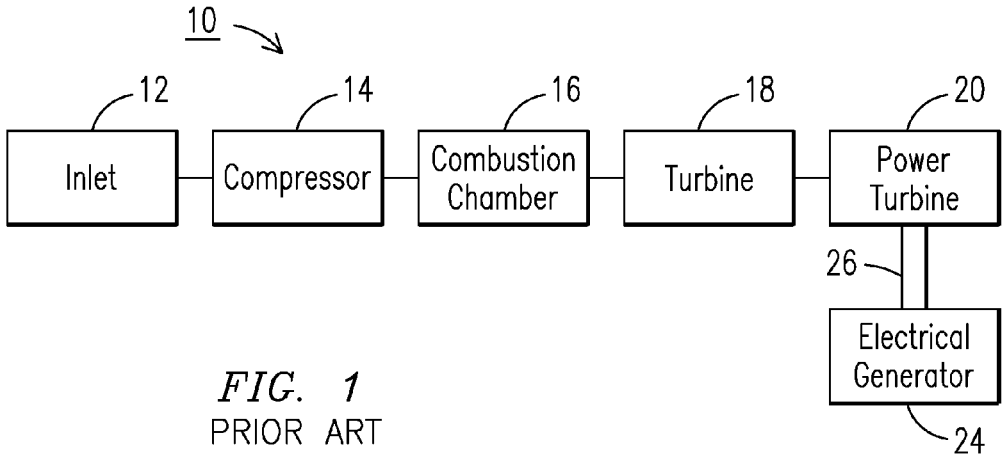
FIG. 1 PRIOR ART
FIG. 1 is a schematic of a conventional combustion system known in the art.

FIG. 1 depicts a typical industrial gas turbine engine 10 comprising in axial flow series: an inlet 12, a compressor section 14, a combustion chamber 16, a turbine section 18, a power turbine section 20 and an exhaust 22. The turbine section 20 is arranged to drive the compressor section 14 via one or more shafts (not shown). Typically, the power turbine section 20 is arranged to drive an electrical generator 24 via a shaft 26.

Figure 2:
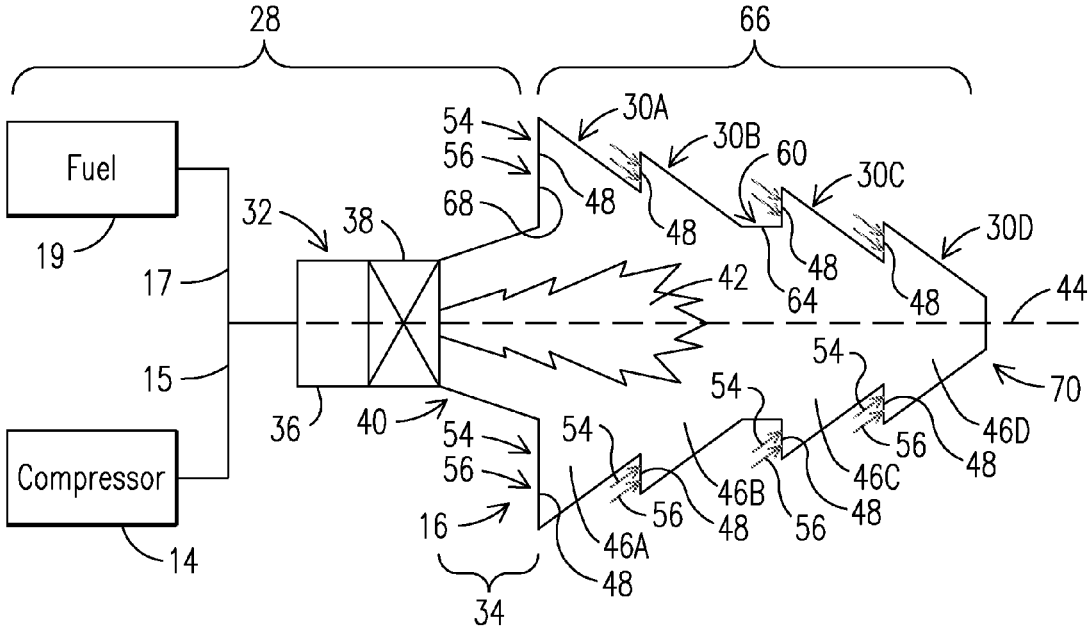
FIG. 2 is a cross-sectional view of a multi-stage axial combustor system in accordance with one aspect of the present invention.

As shown in FIG. 2, combustion chamber 16 comprises a primary combustion stage 28 and secondary combustion stages 30A-D. Primary combustion stage 28 is disposed at a front end 32 of combustion chamber 16 and defines primary combustion zone 34. Primary combustion stage 28 typically includes at least one fuel supply line 17 that provides fuel to the primary combustion stage 28 from a fuel source 19 and at least one air supply line 15 that provides air from an air supply, such as the compressor section 14. The fuel and air may be fed to a mixer for mixing fuel and air provided by the fuel and air supply lines. The mixer mixes the air and fuel so as to provide a pre-mixed fuel air supply that travels through passageway 36. In one embodiment, the mixer is a swirling vane 38 that provides the mixed fuel and air with an annular momentum as it travels through passageway 36. Downstream from passageway 36 in primary combustion stage 28 is a substantially cone-shaped portion 40 of primary combustion zone 34. As the fuel/air mixture travels into cone-shaped portion 40, the fuel/air mixture is ignited with the aid of pilot flame 42 and optionally one or more microburners. At least a portion of the resulting flame travels along a central axis 44 of combustion chamber 16. Cone-shaped portion 40 and the swirling flow of the fuel/air mixture from swirling vane 38 combine to aid in stabilizing pilot flame 42.

Disposed downstream of primary combustion stage 28 are the plurality of secondary combustion stages, for example, four secondary combustion stages 30A-D as shown in FIG. 2. Any number of secondary combustion stages 30A-D may be provided in the present invention. It is contemplated that a greater number of stages will provide improved dynamics, a more stable flame, and better mixing for the combustion system. However, the number of stages must be balanced with other countervailing considerations, namely cost of building additional stages for one. It is understood that embodiments with two or more secondary stages will provide the advantages of the present invention as described herein.

Figure 4:
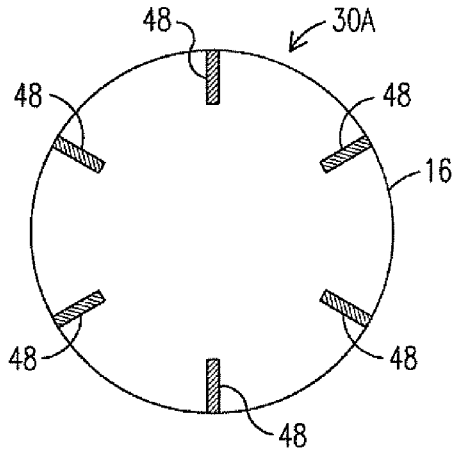
FIG. 4 is a cross-sectional view of an axial stage of the multi-stage axial combustion system of FIG. 2 having a plurality of injectors spaced circumferentially around a perimeter of a combustion chamber in accordance with one aspect of the present invention.

As is also shown in FIG. 2, secondary combustion stages 30A-D are spaced apart in flow series along a length of the combustion chamber 16. Each secondary combustion stage defines a corresponding secondary combustion zone 46A-D. Moreover, each of secondary combustion stages 30A-D comprises a plurality of circumferentially-spaced injectors for injecting fuel, air, or mixtures thereof, toward the central axis 44. As shown in FIG. 4, within each secondary combustion stage, i.e. secondary combustion stage 30A, a plurality of secondary injectors 48 are arrayed radially around a circumference of combustion chamber 16 for providing a secondary fuel/air mixture to a corresponding one of secondary combustion zones 46A-D. The secondary injectors may be spaced apart from one another as desired. In one embodiment, the secondary injectors are spaced apart equidistant from one another. As shown in FIG. 4, for example, there are six injectors 48 spaced apart equally and radially around the circumference of combustion chamber 16 within each secondary combustion stage 30, i.e. stage 30A.

In one embodiment, the majority of secondary injectors are aligned to inject material at substantially the same angle as one another toward the central axis. In this way, a high level of mixing along the central axis 44 of combustion chamber 16 is provided as the fuel/air mixture is directed toward the center of each of secondary combustion stages 30A-D and away from the peripheral walls of each of secondary combustion stages 30A-D. Alternatively, at least one of secondary injectors 48 may be aligned to inject material at an angle different from another one of the secondary injectors 48 toward central axis 44. Typically, injectors 48 are aligned in the same axial direction along a plane transverse to the flow of the fuel/air through combustion chamber 16 so as to provide efficient mixing in the circumferential direction.

Typically also, each secondary injector is fed with fuel, air, or unmixed or pre-mixed mixtures thereof, by one or more lines by a suitable secondary air and/or fuel supply source to feed secondary fuel 54 and secondary air 56 to each secondary injector 48 as shown in FIG. 2. In one embodiment, the fuel, air, or unmixed or pre-mixed mixtures thereof, may be delivered to the secondary injectors by a manifold. In addition, supplementary secondary air may be supplied within any one to all of the secondary combustion stages to provide further secondary air for the combustion combustion process. As shown in FIG. 2, for example, supplemental secondary air 60 is supplied to secondary combustion zone 46B of secondary stage 30B at an end portion 64 of secondary stage 30B. The supplemental secondary air 60 may mix with fuel and/or air being injected from injector 48 of secondary stage 30B and can particularly act to cool the liner or outer portion of combustion chamber 16. The secondary air and/or fuel source may be the same air and/or fuel source providing air and/or fuel to the primary combustion zone, or may be partially or wholly independent therefrom.

Figure 5:
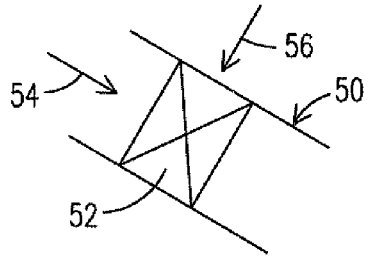
FIG. 5 is a cross-sectional view of a premixed burner in accordance with the present invention.

In one embodiment, at least a portion of the secondary injectors 48 are premixed burners 50 that includes a swirl vane 52 of the type shown in FIG. 5 to provide some premixing of fuel and air fed to each burner 50 prior to injection by burners 50 into a corresponding one of secondary combustion zones 46A-D. In the embodiment of FIG. 5, secondary air 54 is introduced along an axial length of premixed burner 50 while secondary fuel 56 is introduced at a direction normal to the axial length of the premixed burner 50 and the air flow. Alternatively, air and fuel may be fed into each premixed burner at any suitable angle. Premixed burners provide a high level of mixing to the fuel prior to injection into combustion chamber 16, but tend to destabilize the flame flowing along central axis 44 of combustion chamber 16. It is contemplated that when premixed burners are provided, each secondary stage may include six or more premixed burners for providing a mixed fuel/air supply to each secondary combustion zone.

Figure 6:
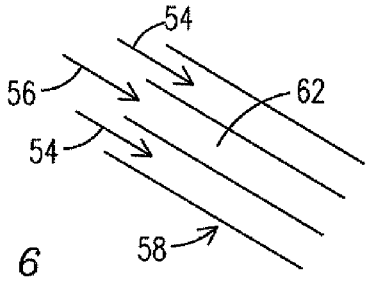
FIG. 6 is a cross-sectional view of a diffusion burner in accordance with the present invention.

In another embodiment, at least a portion of secondary injectors 48 are diffusion burners 58 of the type shown in FIG. 6 where secondary fuel 56 is introduced along a central axis 62 of each diffusion burner 58 in between upper and lower parallel streams of secondary air 54. While diffusion burners do not provide the level of mixing of premix burners generally, diffusion burners provide better dynamics for the overall combustion system. It is contemplated that when diffusion burners are provided, each secondary stage may include sixteen or more diffusion burners for providing a pre-mixed fuel/air supply to each secondary combustion zone.

Figure 7:
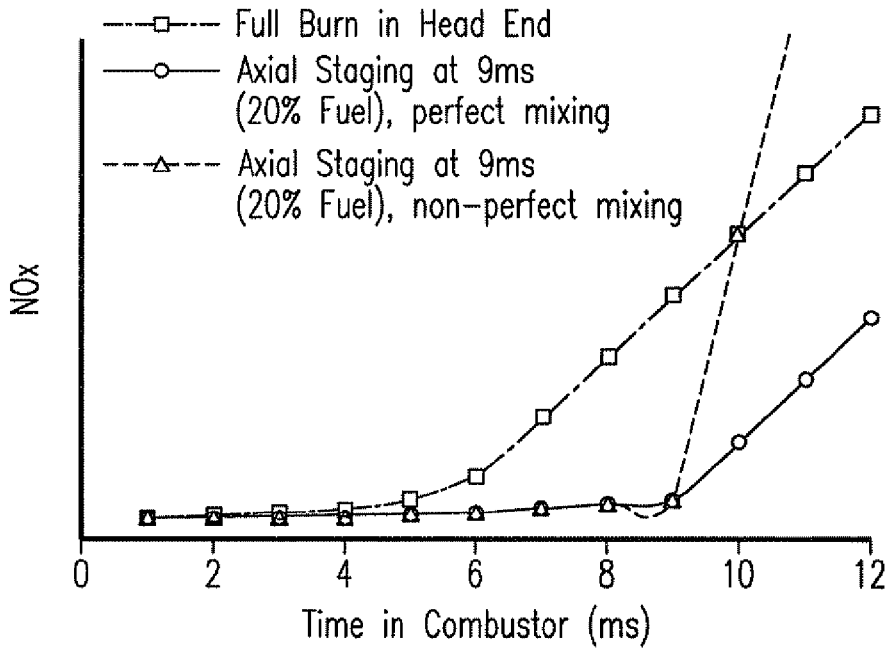
FIG. 7 is a graph comparing the differing amounts of NOx emissions as a result of full burn combustion and perfect mix and non-perfect mix axial staging.

In the present invention, the inventor has surprisingly found that an axial stage design alone as set forth in U.S. Pat. No. 6,418,725, for example, will not sufficiently solve the problem of reducing NOx emissions and maintaining relatively a highly efficient combustion. The inventor has discovered that there must be adequate fuel/air mixing at each axial stage of a multi-stage axial system, otherwise the amount of NOx generated can actually be greater than the NOx generated by a standard full burn in the head end system with no axial staging. As shown in FIG. 7, for example, compared to full burn in the head end of the combustion chamber, perfectly mixed fuel/air at axial stages will reduce NOx emissions. But, as is also shown in FIG. 7, if air/fuel mixing is non-perfect at each axial stage, the amount of NOx generated by combustion due to poor mixing of fuel and air can actually be greater than the full burn in head end case. Thus, the invention provides a multi-stage axial combustion system that ensures optimum mixing of fuel and air at each stage of the multi-stage axial combustion system, as well as uniform combustion and reduced residence time of the fuel/air mixture in the combustion chamber.

To accomplish improved mixing and uniform combustion, as can be seen from the depiction of combustion chamber 16 in FIG. 2, an internal diameter of combustion chamber 16 decreases from at least a first one of the plurality of secondary combustion stages 30A-D to at least a second one of the plurality of secondary combustion stages 30A-D. In one embodiment, by decreasing internal diameters, it is meant that a maximum internal diameter is reduced within at least a first one of the secondary stages and at least a second one of the secondary stages.

Figure 3:
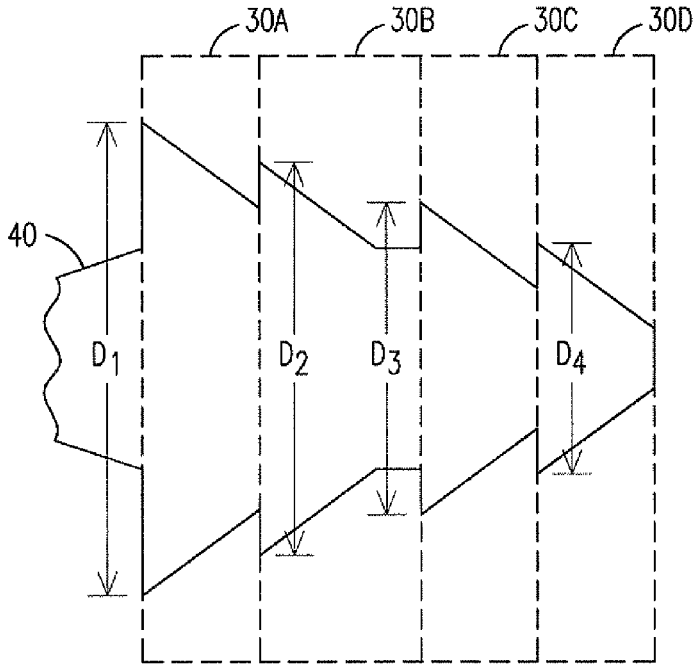
FIG. 3 is another cross-sectional view of the plurality of secondary combustion stages of FIG. 2 in accordance with one aspect of the present invention.

As shown in FIG. 3, secondary combustion stages 30A-D successively decrease in maximum internal diameter $D_1$-$D_4$ in axial flow series along a length of combustion chamber 14. It is contemplated that the internal diameter $D_1$-$D_4$ values of secondary combustion stages 30A-D are typically measured at a location where the largest internal diameter of the combustion stage can be found, such as at or near the front end of each secondary combustion stage as shown in FIG. 3. In the embodiment of FIG. 3, secondary combustion stage 30A has the largest maximum internal diameter ($D_1$) followed by stage 30B ($D_2$), 30C ($D_3$), and 30D ($D_4$). Alternatively, any adjacent secondary combustion stages may have a substantially similar or equal maximum internal diameter and at least one downstream secondary combustion stage will have a smaller maximum internal diameter (unless the subject combustion stage is the last combustion stage in combustion chamber 16). The general area of each secondary stages 30A-D in one embodiment is illustrated in FIG. 3 by the broken lines showing secondary combustion stages 30A-D.

In the embodiments described above, the plurality of secondary combustion stages collectively forms a substantially cone-shaped secondary combustion zone 66 in combustion chamber 14 as shown in FIGS. 2-3. In this way, as fuel and air are injected into the center of the combustion chamber 16, there is a higher probability that the injected fuel and air will be adequately mixed from front end 32 of combustion chamber 16 to an opposed end 70 of combustion chamber 16 before the turbine section 18 of gas turbine engine 10.

Further, in the embodiments described above, as a result of the shape of the substantially cone-shaped secondary combustion zone 66, the fuel, air, or mixtures thereof, injected from the plurality of injectors 48 of the secondary combustion stages 30A-D of combustion chamber 16 are forced into an increasingly smaller cross-sectional area with increasing velocity. In this way, a whipping or swirling effect is increasingly created with the flame and fuel/air mixture traveling along central axis 44 of combustion chamber 16 from front end 32 to opposed end 70 of combustion chamber 16. Thus also, the velocity of the combusted air and fuel along the central axis of the combustion chamber continuously increases from a first one of the plurality of secondary combustion stages to at least a second one of the plurality of secondary combustion stages, thereby providing a better mix of the injected fuel/air mixtures in the secondary combustion stages than axial staging alone.

While the fuel/air mixtures injected from the plurality of injectors of the secondary combustion stages of combustion chamber are forced into a smaller area with increasingly velocity, the multi-stage axial design also allows the injected fuel/air to be distributed broadly and uniformly over the entire region of each secondary combustion zone. In this way, the flame stability and dynamics of the combustion process are improved. In addition, higher flame temperatures are possible in the combustion system for the combustion process. This results in higher combustion efficiency with minimal NOx production than know prior art processes. For example, the inlet temperature to a turbine section of combustion chamber is typically in the range of 1400-1500° C. In the present invention, temperatures of at least about 1700° C. can be reached in the secondary combustion zones and inlet to a turbine section due to uniform distribution of fuel and air and the extent of mixing of the fuel and air.

Also, because the fuel is injected downstream of primary combustion zone 34, the residence time of the fuel/air mixture injected into each of secondary combustion zones 46A-D is relatively short. Moreover, because the secondary combustion stages 30A-D decrease in diameter along an axial flow of the combustion chamber 16 as described above, the residence time of the later-injected flow from secondary combustion stages 30A-D have even further reduced residence times, yet are thoroughly mixed and are uniformly distributed in combustion chamber 16 to create an efficient, stable burn with low NOx emissions. In one embodiment, from about 10% to about 30% by weight of the total fuel injected from the primary combustion stage and the secondary combustion stages is injected in the secondary combustion stages, and in one embodiment, about 20% by weight of the total fuel injected into combustion chamber 16 is injected from the plurality of secondary combustion changes. Put another way, from about 70% to 90%, and in one embodiment, about 80% of the total fuel injected into combustion chamber 16 is injected into primary combustion zone 34. The fuel/air ratio of the fuel/air mix injected into the secondary combustion zones 46A-D may be equal, substantially similar to, or different from the fuel/air mixture injected into primary combustion zone 34 so long as it is determined that good mixing of the fuel/air mixture can be obtained.

Figure 8:
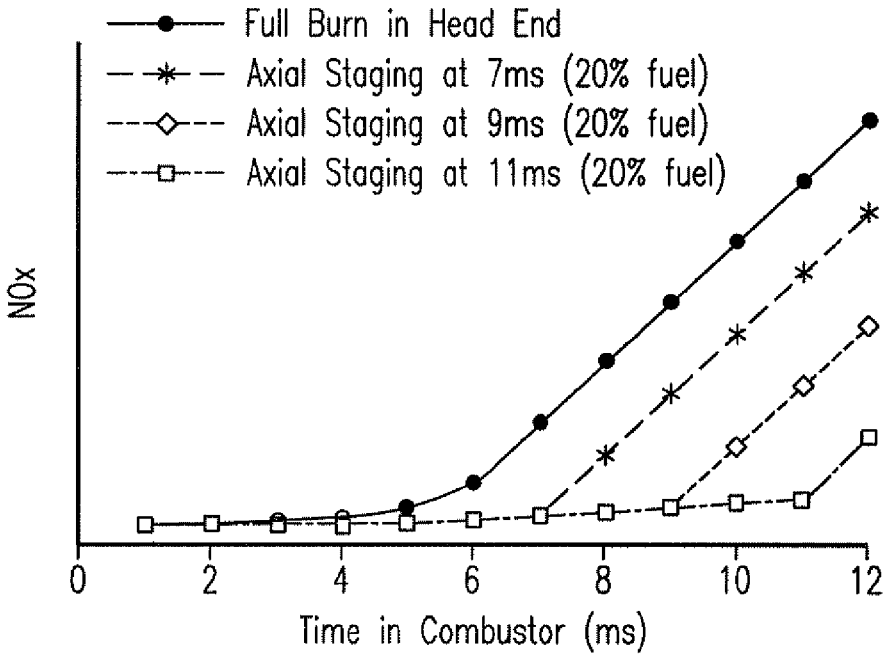
FIG. 8 is a graph comparing the differing amounts of NOx emissions as a result of full burn combustion and axial staging for differing residence times.

In addition, the location of the placement of the secondary combustion stages in the combustor is of importance. As shown in FIG. 8, full burn in head end combustion was compared with axial staging at 7 ms, 9 ms, and 11 ms. With axial-stage injection, the effective residence time of fuel will be reduced and lead to lower NOx emissions. The reference to time in milliseconds in FIG. 8 is meant to refer to the traveling time of the primary fuel from a head end of the combustion chamber to location of a first axial stage. Thus, the later a fuel/air mixture is injected in one of the secondary combustion stages, the longer the length downstream to the point where the first secondary combustion stage is located in the combustion chamber. The inventor has found that by providing the secondary combustion stages further along a length of the combustion chamber may result in lower NOx emissions. While not wishing to be bound by theory, it is believed that the providing of the secondary combustion stages further along a length of the combustion chamber results in lower NOx emissions because the fuel/air mixture is fully burned as close to the end of the combustion chamber as possible such that there is no significant time for NOx emissions to develop. As shown by FIG. 8, full burn at head end produces the greatest amount of NOx emissions, followed by axial staging (with perfect mixing) at 7, 9, and 11 ms. Thus, when fuel/air is injected farther down the combustion chamber in the secondary combustion zones, the result is lower NOx emissions.

The multi-axial stage combustion system described herein can be adapted to a can or annular combustion chamber as are known in the art. Typically, a combustion system having a can combustion chamber typically also includes also transition between an end of the combustion chamber and the turbine section. It is contemplated that if desired, therefore, at least some of the plurality of secondary combustion chambers could be located in the transition of such a can combustor system. Typically, annular combustion chambers do not include a transition element. Thus, the primary and secondary combustion stages described herein are typically located within the annular combustion chamber. If a can combustion chamber is provided, generally each secondary combustion stage includes eight or more injectors spaced circumferentially around a perimeter of the combustion chamber. Conversely, if an annular combustion chamber is provided, generally each secondary combustion stage includes twenty-four or more of injectors spaced circumferentially around a perimeter of the combustion chamber.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A gas turbine combustion system, comprising:

a combustion chamber having a central axis;

a pilot flame located within a primary combustion stage at a front end of the combustion chamber for combusting a first amount of injected fuel;

a plurality of secondary combustion stages spaced apart in flow series along a length of the combustion chamber, wherein each of the plurality of secondary combustion stages comprises a plurality of circumferentially-spaced secondary injectors for injecting a second amount of fuel, air, or mixtures thereof, toward the central axis;

wherein a minimum internal diameter of a first one of the plurality of secondary combustion stages is greater than a minimum internal diameter of at least a second downstream one of the plurality of secondary combustion stages.

2. The apparatus of claim 1, wherein the plurality of secondary combustion stages form a substantially cone-shaped secondary combustion zone in the combustion chamber.

3. The apparatus of claim 1, wherein the primary combustion stage comprises:

at least one fuel supply line and a first air supply line; and a mixer for mixing fuel and air provided by the at least one fuel supply line and the first air supply line.

4. The apparatus of claim 1, wherein each of the plurality of secondary injectors in at least one of the plurality of secondary stages is aligned to inject material at substantially the same angle toward the central axis.

5. The apparatus of claim 1, wherein at least one of the plurality of secondary injectors of at least one of the plurality of secondary stages is aligned to inject material at an angle different from another one of the plurality of secondary injectors in that one secondary stage toward the central axis.

6. The apparatus of claim 1, wherein each of the plurality of secondary combustion stages comprises:

at least one secondary fuel supply line and a secondary air supply; and a second mixer for mixing fuel and air supplied by the at least one secondary fuel supply line and the secondary air supply, the mixer being disposed within each of the plurality of secondary injectors.

7. The gas turbine combustion system of claim 1, wherein a velocity of the combusted air and fuel along the central axis of the combustion chamber increases from a first one of the plurality of secondary combustion stages to at least a second one of the plurality of secondary combustion stages.

8. A gas turbine combustion system, comprising:

(a) a combustion chamber having a central axis;

(b) a primary combustion stage located at a front end of the combustion chamber, wherein the primary combustion stage comprises:

at least one fuel supply line and an air supply line;

a mixer for mixing fuel and air supplied by the at least one fuel supply line and the air supply line and for providing a fuel-air mixture;

a substantially cone-shaped portion disposed downstream from the first mixing means; and a pilot flame within the substantially cone-shaped portion for combusting the fuel-air mixture mixed along a central axis of the combustion chamber; and (c) a plurality of secondary combustion stages spaced apart in flow series along a length of the combustion chamber, wherein each of the plurality of secondary combustion stages comprises plurality of secondary injectors spaced circumferentially around a perimeter of each of the plurality of secondary combustion stages, and wherein a minimum internal diameter of a first one of the plurality of secondary combustion stages is greater than a minimum internal diameter of to at least a second downstream one of the plurality of secondary combustion stages.

9. The apparatus of claim 8, wherein the plurality of secondary combustion stages form a substantially cone-shaped second combustion zone of the combustion chamber.

10. The apparatus of claim 8, wherein a velocity of the combusted air and fuel along the central axis of the combustion chamber increases from a first one of the plurality of secondary combustion stages to at least a second one of the plurality of secondary combustion stages.

* * * * *